US010480193B2

(12) United States Patent
Brochu

(10) Patent No.: US 10,480,193 B2
(45) Date of Patent: Nov. 19, 2019

(54) GUTTER COVER, GUTTER ASSEMBLY INCLUDING SAME, AND METHOD FOR INSTALLATION THEREOF

(71) Applicant: Stéphane Brochu, Saint-Romuald (CA)

(72) Inventor: Stéphane Brochu, Saint-Romuald (CA)

( * ) Notice: Subject to any disclaimer, the term of this patent is extended or adjusted under 35 U.S.C. 154(b) by 0 days.

(21) Appl. No.: 15/605,283

(22) Filed: May 25, 2017

(65) Prior Publication Data

US 2017/0342717 A1 Nov. 30, 2017

Related U.S. Application Data

(60) Provisional application No. 62/342,299, filed on May 27, 2016.

(30) Foreign Application Priority Data

May 27, 2016 (CA) ..... 2931540

(51) Int. Cl.

| | |
|---|---|
| ***E04D 13/076*** | (2006.01) |
| ***B21D 28/26*** | (2006.01) |
| *B21D 28/24* | (2006.01) |
| *E04D 13/04* | (2006.01) |

(52) U.S. Cl.

CPC ..... *E04D 13/076* (2013.01); *B21D 28/26* (2013.01); *B21D 28/24* (2013.01); *E04D 13/04* (2013.01)

(58) Field of Classification Search

CPC . E04D 13/076; E04D 13/064; E04D 13/0725; E04D 13/072; E04D 13/158; E04D 13/0643; E04D 13/0685

USPC ..... 52/11, 12, 13, 14, 15, 16; 248/48.1, 248/48.2; 210/155

See application file for complete search history.

(56) References Cited

U.S. PATENT DOCUMENTS

| | | | | |
|---|---|---|---|---|
| 2,175,521 A * | 10/1939 | Fry | E04D 13/076 | 52/12 |
| 2,209,741 A * | 7/1940 | Sullivan | E04D 13/076 | 210/474 |
| 2,988,226 A * | 6/1961 | Campbell | E04D 13/076 | 210/474 |
| 3,295,264 A * | 1/1967 | Olson | E04D 13/076 | 160/349.1 |
| 3,367,070 A * | 2/1968 | Mitchell | E04D 13/0725 | 210/474 |
| 4,553,356 A * | 11/1985 | Pepper | E04D 13/076 | 52/11 |

(Continued)

FOREIGN PATENT DOCUMENTS

| | | |
|---|---|---|
| CA | 2 305 159 A1 | 10/2001 |
| CA | 2 405 756 A1 | 3/2004 |

(Continued)

*Primary Examiner* — Kyle J. Walraed-Sullivan
(74) *Attorney, Agent, or Firm* — Merchant & Gould P.C.

(57) ABSTRACT

A gutter cover is engageable in a rain gutter channel to close a top opening of a rain gutter. The gutter cover includes a sheet of rigid and resilient material, the sheet having a pre-formed curved profile along a widthwise axis thereof, two opposing longitudinal edges, and a plurality of through-holes formed therein, the sheet being substantially flexible to modify its pre-formed curved profile for insertion into the rain gutter channel. A gutter assembly includes the gutter cover inserted in a gutter and in a method, the gutter cover engages with a gutter.

40 Claims, 5 Drawing Sheets

(56) References Cited

U.S. PATENT DOCUMENTS 4,841,686 A * 6/1989 Rees ..... E04D 13/076 210/474
4,907,381 A * 3/1990 Ealer ..... E04D 13/076 52/12
4,937,986 A * 7/1990 Way, Sr. ..... E04D 13/076 210/474
5,044,581 A * 9/1991 Dressler ..... E04D 13/076 248/48.1
5,154,025 A * 10/1992 Brown ..... E04D 13/0459 52/12
5,271,192 A * 12/1993 Nothum, Sr. ..... E04D 13/076 248/48.2
5,406,754 A * 4/1995 Cosby ..... E04D 13/076 52/12
5,848,857 A * 12/1998 Killworth ..... E04D 13/076 210/474
6,098,345 A * 8/2000 Demartini ..... E04D 13/076 210/474
6,314,698 B1 11/2001 Johansson
D460,197 S 7/2002 Stringer
6,427,388 B1 8/2002 Brochu
6,463,700 B2 * 10/2002 Davis ..... E04D 13/076 210/474
D468,446 S 1/2003 Sender et al.
6,598,352 B2 7/2003 Higginbotham
6,718,717 B2 4/2004 Henderson et al.
6,786,008 B2 * 9/2004 Brochu ..... E04D 13/076 248/48.1
6,826,872 B2 12/2004 Brochu
6,932,911 B1 * 8/2005 Groth ..... E04D 13/076 210/162
D523,538 S 6/2006 Brochu
D523,969 S 6/2006 Abruzese et al.
D551,740 S 9/2007 Riley
D558,309 S 12/2007 Gregg
7,310,912 B2 12/2007 Lenney et al.
D569,011 S 8/2008 Brochu
7,614,185 B2 * 11/2009 Brochu ..... E04D 13/076 52/11
7,624,541 B2 12/2009 Gentry
7,627,991 B1 * 12/2009 Feldhaus ..... E04D 13/076 210/155
7,658,036 B2 2/2010 Banks et al.
7,765,743 B2 8/2010 Guilford
7,793,465 B2 * 9/2010 McCann ..... E04D 13/076 52/11
7,900,414 B2 3/2011 Seccombe
7,908,797 B2 3/2011 Graves
7,913,458 B2 3/2011 Higginbotham
8,001,729 B2 * 8/2011 Joly, Jr. ..... E04D 13/076 248/48.1
8,037,641 B2 10/2011 Gerig
RE42,896 E * 11/2011 Higginbotham ..... E04D 13/076 210/474
D651,292 S 12/2011 Geers
8,191,315 B1 6/2012 Brochu
8,322,082 B2 12/2012 Neumann
8,375,644 B2 2/2013 Robbins
D677,405 S 3/2013 Landis
8,402,697 B1 * 3/2013 Ealer, Sr. ..... E04D 13/076 52/12
8,434,269 B1 5/2013 Brochu
8,479,454 B2 7/2013 Lenney et al.
8,578,658 B2 * 11/2013 Snell ..... E04D 13/076 210/474
8,635,811 B2 1/2014 Horton
8,707,648 B2 4/2014 Timko et al.
8,720,122 B1 * 5/2014 Feldhaus ..... E04D 13/076 52/12
8,844,208 B1 * 9/2014 Feldhaus ..... E04D 13/076 52/12
D719,648 S 12/2014 Moody et al.
D721,826 S 1/2015 Ryan
D723,671 S 3/2015 Brochu
9,010,029 B2 4/2015 Higginbotham
9,010,030 B2 4/2015 Davis
D736,900 S 8/2015 Frelier
9,127,463 B1 9/2015 Feldhaus
9,163,406 B1 10/2015 Ealer, Sr.
D742,541 S 11/2015 Ryan
9,181,706 B1 * 11/2015 Livers ..... E04D 13/076
9,309,677 B1 4/2016 Anic
D770,603 S 11/2016 Fryml
2003/0046876 A1 3/2003 Higginbotham
2003/0110712 A1 6/2003 Brochu
2004/0060244 A1 4/2004 Brochu
2004/0118052 A1 6/2004 Brochu
2004/0182014 A1 9/2004 Brochu
2004/0187394 A1 * 9/2004 Brochu ..... E04D 13/076 52/12
2004/0244302 A1 12/2004 Neumann
2005/0028452 A1 2/2005 Brochu
2005/0115158 A1 * 6/2005 Brown ..... E04D 13/064 52/11
2005/0115160 A1 6/2005 Brochu
2005/0172565 A1 8/2005 Riley et al.
2005/0193642 A1 9/2005 Brochu et al.
2005/0193671 A1 9/2005 Brochu et al.
2005/0223657 A1 10/2005 Brochu et al.
2005/0279036 A1 12/2005 Brochu
2006/0037254 A1 2/2006 Brochu
2006/0037255 A1 2/2006 Brochu
2006/0053697 A1 * 3/2006 Higginbotham ..... E04D 13/076 52/12
2006/0117672 A1 * 6/2006 Kurple ..... E04D 13/076 52/12
2006/0123710 A1 6/2006 Lenney et al.
2006/0179723 A1 8/2006 Robins
2006/0201068 A1 * 9/2006 Shane ..... E04D 13/064 52/11
2006/0230687 A1 * 10/2006 Ealer, Sr. ..... E04D 13/076 52/12
2006/0283097 A1 12/2006 Gregg
2007/0017162 A1 1/2007 Staub
2007/0089372 A1 * 4/2007 Hammond ..... E04D 13/076 52/11
2007/0167130 A1 7/2007 Brochu
2007/0169423 A1 7/2007 Brochu
2007/0267310 A1 * 11/2007 Berkowitz ..... E04D 15/06 206/410
2007/0277446 A1 * 12/2007 Dowling ..... E04D 13/076 52/11
2008/0010906 A1 1/2008 Brochu
2008/0134587 A1 * 6/2008 Ealer ..... E04D 13/076 52/12
2008/0163561 A1 7/2008 Lenney et al.
2008/0190039 A1 8/2008 Brochu
2008/0190070 A1 8/2008 Duncan et al.
2008/0289263 A1 11/2008 Brochu
2009/0013612 A1 1/2009 Brochu
2009/0053529 A1 * 2/2009 Kenney ..... B32B 27/08 428/422
2009/0056234 A1 3/2009 Brochu
2009/0108144 A1 4/2009 Brochu
2010/0287846 A1 11/2010 Lenney
2011/0056145 A1 3/2011 Lenney et al.
2011/0067317 A1 3/2011 Hedrick
2011/0067318 A1 3/2011 Lenney et al.
2011/0126477 A1 * 6/2011 Hum ..... E04D 13/076 52/12
2011/0138698 A1 * 6/2011 Neumann ..... E04D 13/076 52/12
2011/0185641 A1 * 8/2011 Snell ..... E04D 13/076 52/12
2011/0185642 A1 8/2011 DeHart, Sr.
2012/0151849 A1 * 6/2012 Brochu ..... E04D 3/364 52/12
2012/0192502 A1 * 8/2012 Glander ..... E04D 13/076 52/12
2012/0213974 A1 8/2012 Olvey

(56) References Cited

U.S. PATENT DOCUMENTS

| | | | | |
|---|---|---|---|---|
| 2012/0222366 | A1* | 9/2012 | Steinberg | E04D 13/076 52/12 |
| 2013/0091780 | A1 | 4/2013 | Robins | |
| 2013/0145699 | A1* | 6/2013 | Olthoff | E04D 13/076 52/12 |
| 2013/0160377 | A1* | 6/2013 | Sager | E04D 13/076 52/12 |
| 2013/0305621 | A1* | 11/2013 | Szafranski | E04D 13/076 52/12 |
| 2014/0013563 | A1 | 1/2014 | Richardson et al. | |
| 2014/0069028 | A1 | 3/2014 | Lenney | |
| 2014/0215929 | A1 | 8/2014 | Lenney | |
| 2014/0223837 | A1* | 8/2014 | Pavlansky | E04D 13/076 52/12 |
| 2015/0020462 | A1 | 1/2015 | Iannelli | |
| 2015/0040488 | A1 | 2/2015 | Lenney | |
| 2015/0089883 | A1* | 4/2015 | Peck | E04D 13/076 52/12 |
| 2015/0143756 | A1 | 5/2015 | Higginbotham | |
| 2015/0225959 | A1 | 8/2015 | Lenney | |
| 2015/0330085 | A1 | 11/2015 | Iannelli | |
| 2016/0168857 | A1 | 6/2016 | Neumann et al. | |
| 2016/0340909 | A1 | 11/2016 | Riebel et al. | |
| 2016/0369512 | A1 | 12/2016 | Lenney | |
| 2017/0044774 | A1 | 2/2017 | Anic | |
| 2017/0058529 | A1* | 3/2017 | Brochu | E04D 13/0767 |
| 2017/0058531 | A1 | 3/2017 | Brochu | |
| 2017/0204611 | A1 | 7/2017 | Brochu | |
| 2018/0030733 | A1* | 2/2018 | Brochu | E04D 13/076 |

FOREIGN PATENT DOCUMENTS

| | | | | |
|---|---|---|---|---|
| CA | 2 458 005 | A1 | 8/2005 | |
| CA | 2 458 006 | A1 | 8/2005 | |
| CA | 2 460 429 | A1 | 9/2005 | |
| CA | 2 541 186 | A1 | 7/2007 | |
| CA | 2 593 808 | A1 | 1/2009 | |
| CA | 2 608 530 | A1 | 4/2009 | |
| CA | 2 723 499 | A1 | 3/2011 | |
| CA | 2 727 844 | A1 | 7/2012 | |
| CA | 2 747 513 | A1 | 1/2013 | |
| CA | 2 783 834 | A1 | 8/2013 | |
| CA | 2 775 864 | A1 | 11/2013 | |
| CA | 2 863 023 | A1 | 3/2016 | |
| CA | 2 747 704 | C | 4/2016 | |
| CA | 2 907 280 | A1 | 2/2017 | |
| CA | 2 919 709 | A1 | 8/2017 | |
| EP | 1 449 980 | A1 | 8/2004 | |
| EP | 1 627 974 | A2 | 2/2006 | |
| EP | 2 159 342 | A1 | 3/2010 | |
| EP | 2 177 685 | A1 | 4/2010 | |
| EP | 2 251 500 | A1 | 11/2010 | |
| GB | 2 481 033 | A | 12/2011 | |
| GB | 2 493 284 | A | 1/2013 | |
| WO | WO-9922093 | A1 * | 5/1999 | E04D 13/064 |
| WO | 2007/100320 | A1 | 9/2007 | |
| WO | 2008/134845 | A1 | 11/2008 | |
| WO | 2009/150174 | A2 | 12/2009 | |

* cited by examiner

GUTTER COVER, GUTTER ASSEMBLY INCLUDING SAME, AND METHOD FOR INSTALLATION THEREOF

CROSS-REFERENCE TO RELATED APPLICATION

This application claims priority under 35 U.S.C. 119 of U.S. provisional patent application No. 62/342,299, filed on 27 May 2016 and Canadian Patent Application No. 2,931,540, filed on 27 May 2016, and entitled "GUTTER COVER, GUTTER ASSEMBLY INCLUDING SAME, AND METHOD FOR INSTALLATION THEREOF", the disclosures of which are hereby incorporated by reference in their entireties. To the extent appropriate, a claim of priority is made to each of the above disclosed applications.

TECHNICAL FIELD

The technical field generally relates to a gutter cover and more particularly to a gutter cover for a rain gutter. It also relates to a gutter assembly including the gutter cover and to a method for installation thereof.

BACKGROUND

Rain gutters collect water that run off roofs and eaves of buildings and channel the collected water so that the water can be expelled to a safe location. However, rain gutters are also prone to collect solid debris that is found in the water, which may cause clogs of the rain gutters over time. The use of a gutter cover may restrict ingress of solids into the channel of the rain gutter.

Gutter covers should not rust, crack, chip or warp. They should also be built tough to support the weight of snow and debris.

SUMMARY

It is therefore an aim of the present invention to address the above mentioned issues.

According to a general aspect, there is provided a gutter cover engageable in a rain gutter channel to close a top opening of a rain gutter. The gutter cover comprises: a sheet of rigid and resilient material, the sheet having a pre-formed curved profile along a widthwise axis thereof, two opposing longitudinal edges, and a plurality of throughholes formed therein, the sheet being substantially flexible to modify its pre-formed curved profile for insertion into the rain gutter channel.

In an embodiment, the pre-formed curved profile is arch-shaped.

In an embodiment, the longitudinal edges of the sheet are biased in an outward widthwise direction when the sheet is flexed in an inward widthwise direction.

In an embodiment, the longitudinal edges can be biased in an inward widthwise direction when the sheet is flexed in an outward widthwise direction.

In an embodiment, the sheet further comprises at least one fold line extending along a longitudinal axis thereof.

In an embodiment, the at least one fold line can be folded inwardly.

In an embodiment, the at least one fold line can include a plurality of fold lines extending substantially parallel to one another and being spaced-apart from one another along the widthwise axis with a central fold line extending substantially along a longitudinal center of the sheet.

In an embodiment, the at least one fold line can increase rigidity of the sheet when the sheet is flexed in an inward widthwise direction. The at least one fold line can guide flexing of the sheet when the sheet is flexed in an inward widthwise direction.

In an embodiment, a top surface of the sheet defines a first substantially smooth curve extending over an entire width of the sheet; and wherein a bottom surface of the sheet defines a second substantially smooth curve extending over the entire width of the sheet.

In an embodiment, the sheet is flexible along a longitudinal axis thereof, whereby the sheet is rollable onto itself into a roll.

In an embodiment, the sheet can be substantially flattened when the sheet is rolled and the sheet can substantially return to its pre-formed curved profile when unrolled.

According to another general aspect, there is provided a gutter assembly comprising: a rain gutter having a rain gutter body with an elongated front wall and an opposed elongated rear wall defining a rain gutter channel with a top opening, the rain gutter including inner retaining members protruding inwardly inside the rain gutter channel from the elongated front and rear walls; and a gutter cover as described above, insertable in the rain gutter channel to substantially close the top opening thereof and the sheet being maintained inside the rain gutter channel by frictionally engaging the inner retaining members of the rain gutter.

In an embodiment, the longitudinal edges of the sheet are frictionally engageable with inner faces of the front and rear elongated walls of the rain gutter under a biasing force of the sheet in an outward widthwise direction.

In an embodiment, when engaged in the rain gutter channel of the rain gutter, the gutter cover is flexed in an inward widthwise direction and the longitudinal edges are biased in an outward widthwise direction.

In an embodiment, the inner retaining members comprise one or more gutter fasteners for securing the rain gutter to a support surface, the sheet being inserted under the one or more gutter fasteners when engaged with the rain gutter.

In an embodiment, the inner retaining members comprise an inwardly extending upper lip of the rain gutter extending inwardly into the rain gutter channel from an upper edge of a respective one of the front and the rear elongated walls, the sheet is inserted under the inwardly extending upper lip of the rain gutter when engaged therewith.

In an embodiment, a middle portion of the sheet extends above the inner retaining members when engaged therewith.

In an embodiment, the gutter cover is unsecured to the rain gutter when engaged therewith.

According to still another general aspect, there is provided a method of installing a gutter cover to cover a top opening of a rain gutter. The method comprises:

providing a gutter cover as described above;

applying a force to cause flexing of the sheet of the gutter cover in an inward widthwise direction of the gutter cover;

inserting the gutter cover while the sheet is flexed through the top opening of the rain gutter; and releasing the gutter cover inside the rain gutter channel, whereby the longitudinal edges of the sheet of gutter cover are biased in an outward widthwise direction to frictionally engage inner retaining members of the rain gutter.

DETAILED DESCRIPTION

In the following description, there is described various embodiments related to a gutter cover for use in combination with a rain gutter. As will be readily understood by one skilled in the art, the gutter cover and methods for installation thereof according to the embodiments presented herein and equivalents thereto may be provided separately or in combination.

Although the embodiments of the gutter cover and methods for installation thereof include certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the gutter cover and methods for installation thereof, as will be briefly explained herein and as can be easily inferred herefrom by a person skilled in the art.

Moreover, it will be appreciated that positional descriptions such as "inward", "outward", "top", "bottom", "inner", "upper", and the like should be taken in the context of the figures only and should not be considered limiting.

Having discussed the general context of the gutter cover and methods for installation thereof, optional embodiments will be discussed further hereinbelow. The embodiments according to the following description are given for exemplification purposes only.

An element having a "pre-formed" shape herein refers to that element being formed to acquire that shape during manufacturing of the element such that the element maintains that shape after completion of manufacturing.

Figure 1:
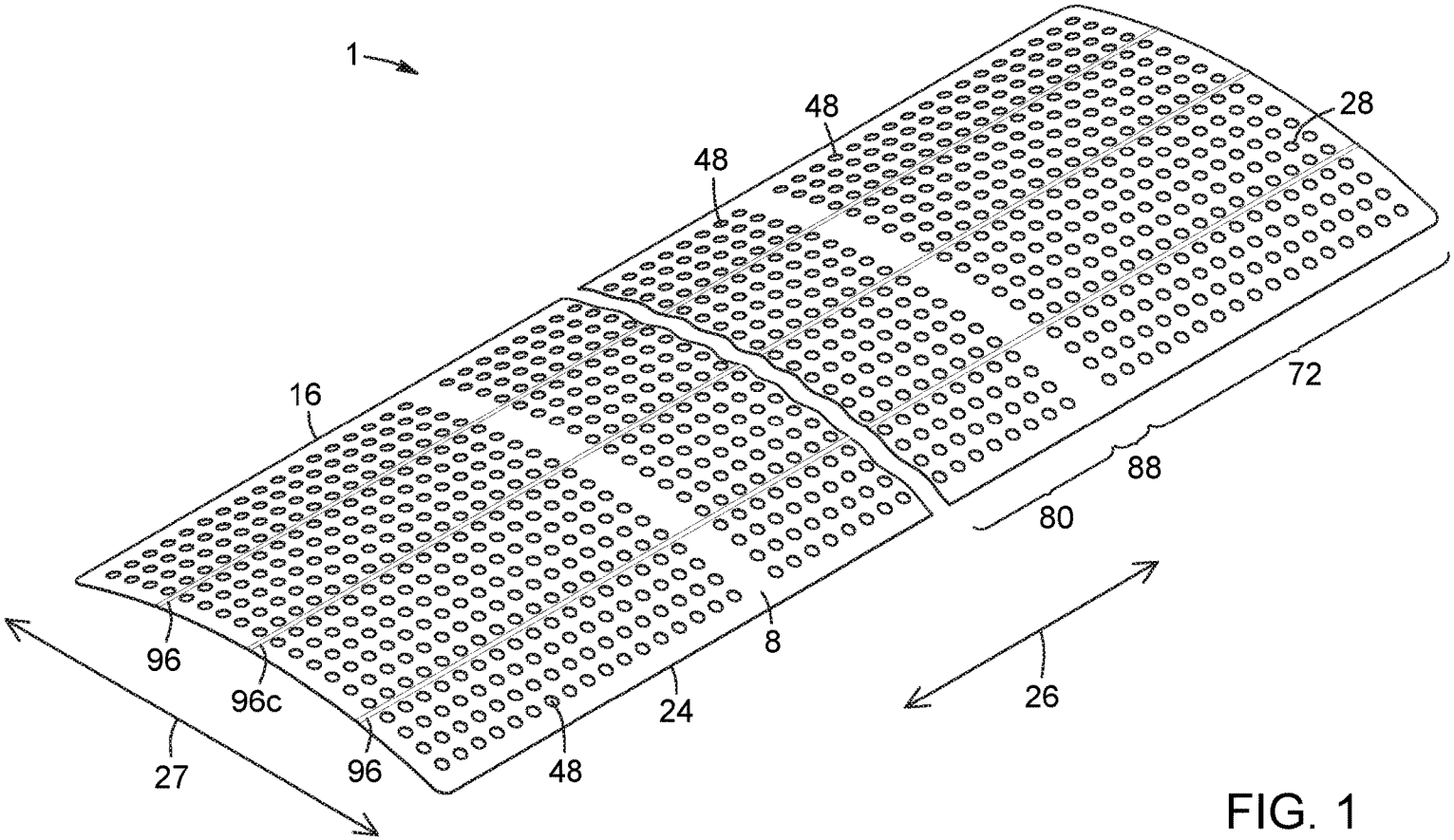
FIG. 1 illustrates a perspective view of a gutter cover according to one example embodiment.
Figure 2:
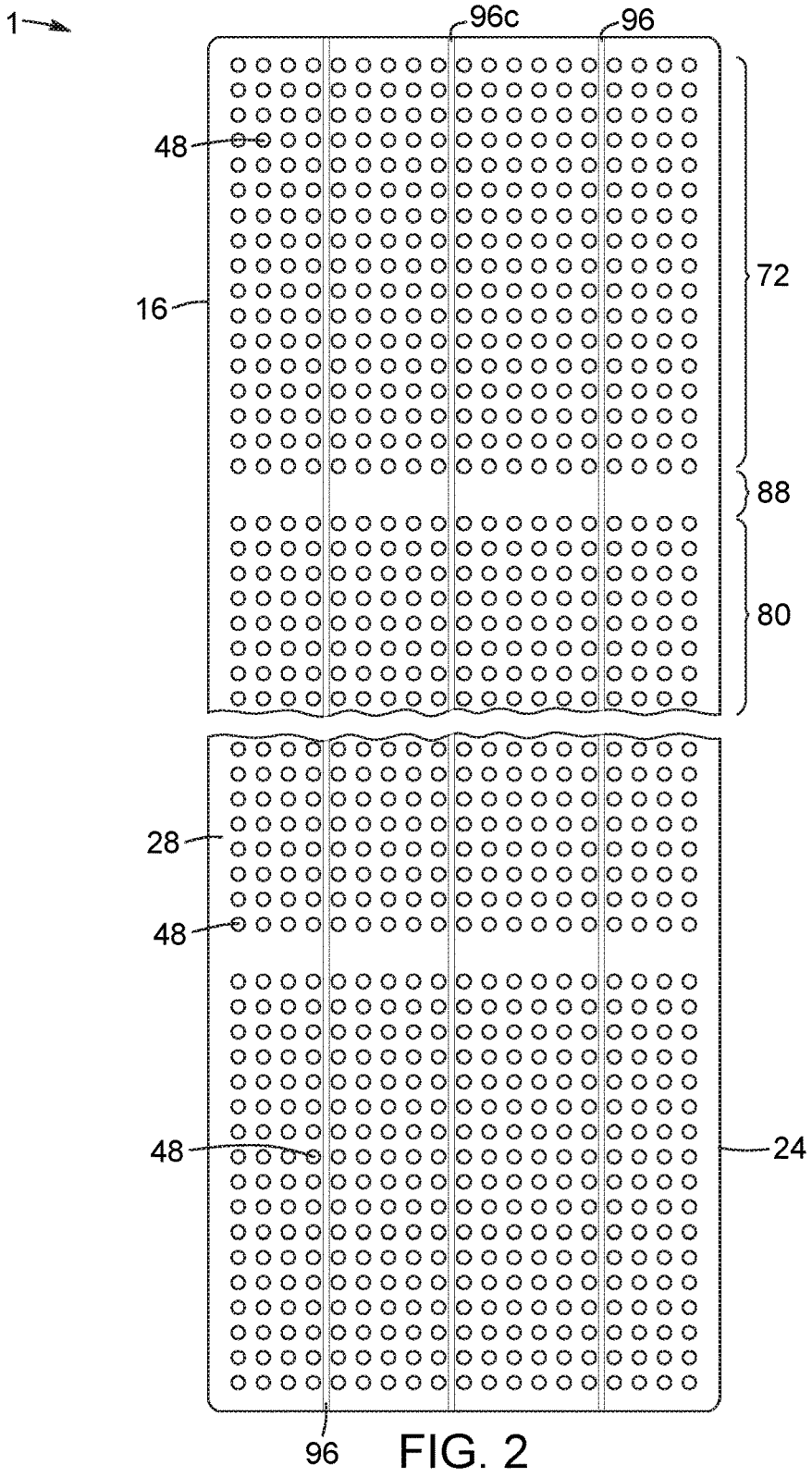
FIG. 2 illustrates a top plan view of the gutter cover of FIG. 1.
Figure 4:
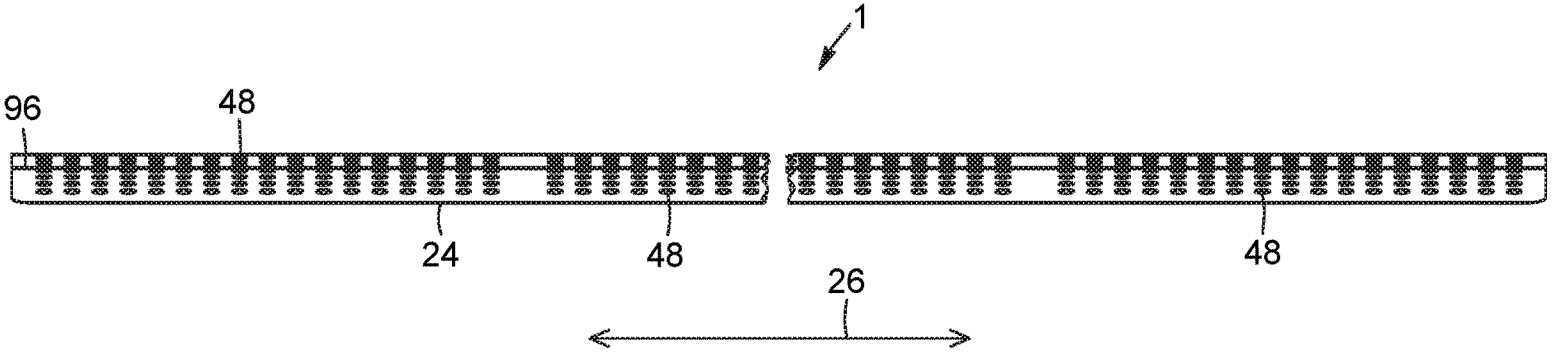
FIG. 4 illustrates an elevation view from a first side of the gutter cover of FIG. 1.

Referring now to FIG. 1, therein illustrated is a perspective view of a gutter cover (1) according to one example embodiment. FIG. 2 illustrates a top plan view of the gutter cover (1) according to the example embodiment. FIG. 4 illustrates a side elevation view of the gutter cover (1) according to the example embodiment.

The gutter cover (1) comprises a sheet (8) formed of a relatively rigid and resilient material, such as and without being limitative, aluminum. The sheet (8) has two opposing longitudinal edges (16) and (24) extending substantially parallel to one another along a longitudinal axis (26) of the sheet (8). The sheet (8) further defines a widthwise axis (27), extending substantially perpendicular to the longitudinal axis (26) and extending between the opposing longitudinal edges (16) and (24).

Figure 3:
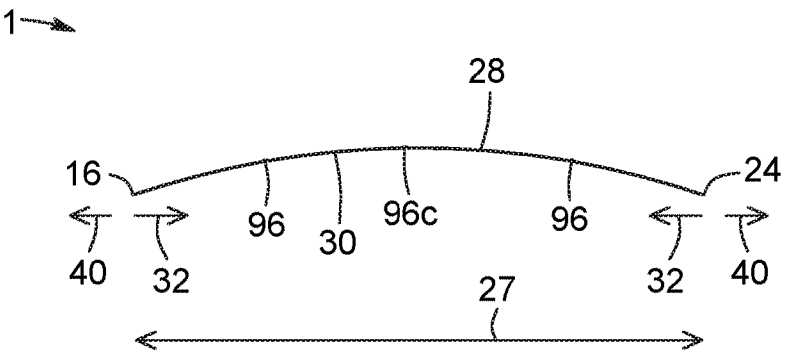
FIG. 3 illustrates a cross-section view of the gutter cover of FIG. 1.

Referring now to FIG. 3, there is shown that the sheet (8) has a pre-formed curved profile along its widthwise axis (27). It will be appreciated that the widthwise cross-section of the sheet (8), corresponding to its pre-formed curved profile, may be arch-shaped, i.e. it is shaped like a segment of a circle. In an embodiment, the diameter of the corresponding circle could be between 8 cm and 45 cm.

According to one example embodiment, and as illustrated in FIG. 3, the top surface (28) and the bottom surface (30) of the sheet (8) define a substantially smooth and continuous curve extending along the widthwise axis (27) from the first longitudinal edge (16) to the second longitudinal edge (24). It will be understood that the top surface (28) of the sheet (8) defines a substantially smooth curve in that the top surface (28) does not have any substantial breaks that would cause the forming of a corner (other than fold lines (96), creating almost invisible discontinuities in the curved profile, as will be described in more details below). In the embodiment shown, the curvature of the top surface (28) extends substantially parallel to the curvature of the bottom surface (30).

The sheet (8) having the pre-formed curved profile is substantially flexible. As described hereinbelow, the sheet (8) is sufficiently flexible to modify its curved profile so that the gutter cover (1) may be inserted into a rain gutter channel of a rain gutter or rolled onto itself for shipping and storage, as will be described in more details below.

More particularly, the sheet (8) is at least adapted to be flexible in an inward widthwise direction. The inward widthwise direction corresponds to a direction extending from either of the opposing longitudinal edges (16) and (24) towards a longitudinal center of the sheet (8), as denoted by arrows (32) (see FIG. 3). The flexing of the sheet (8) in the inward widthwise direction causes the distance between the opposing longitudinal edges (16, 24) to be decreased and, thus, the curvature of the sheet (8) to be increased. Accordingly, a width (or footprint) of the gutter cover (1) along the widthwise axis (27) is decreased from this flexing. Flexing of the sheet (8) in the inward widthwise direction can be performed to insert the gutter cover (1) into a rain gutter channel of a rain gutter, as will be described in more details below.

Similarly, the sheet (8) is also adapted to be flexible in an outward widthwise direction, as denoted by arrows (40) (see FIG. 3). The outward widthwise direction corresponds to a direction extending from either of the opposing longitudinal edges (16, 24) away from a longitudinal center of the sheet (8). The flexing of the sheet (8) in the outward widthwise direction causes the distance between the opposing longitudinal edges (16, 24) to be increased and, thus, the curvature of the sheet (8) to be decreased or the sheet (8) to be flattened. Accordingly, the footprint of the gutter cover (1) along the widthwise axis (27) is increased from this flexing. Flexing of the sheet (8) in the outward widthwise direction can be performed to roll the gutter cover (1) onto itself for shipping and storage, as will be described in more details below.

The sheet (8), when in the unstressed configuration, may be defined by its cross-section having a first unstressed and pre-formed curvature, as illustrated, for example, in FIG. 3. The cross-section of the sheet (8) has a second curvature that is greater than the first curvature when the sheet (8) is flexed in the inward widthwise direction (32) or another curvature that is lower than the first curvature when the sheet (8) is flexed in the outward widthwise direction (40).

The sheet (8) is also resilient and is biased towards returning to an unstressed shape corresponding to its pre-formed curved profile. The flexing of the sheet (8) causes the sheet (8) to be shaped away from its unstressed shape. When the sheet (8) is flexed in the inward widthwise direction (32), the opposing longitudinal edges (16) and (24) are biased in the outward widthwise direction as denoted by arrows (40) (see FIG. 3). That is, the sheet (8) being resilient causes a force in the outward widthwise direction to be applied when the sheet (8) is flexed inwardly. When a force is disapplied so that the sheet (8) is no longer flexed (ex: when the sheet (8) is released), the sheet (8) returns to its unstressed pre-formed curved profile. Similarly, when the sheet (8) is flexed in the outward widthwise direction (40), the opposing longitudinal edges (16) and (40) are biased in the inward widthwise direction (32).

The sheet (8) is sufficiently rigid so as to substantially maintain its shape when a downward force corresponding to flow of water and solids onto the top surface (28), for instance, from the roof of a building to which a gutter including the gutter cover (1) is mounted. The pre-formed curved profile of the sheet (8) may contribute to the rigidity to the sheet (8) forming the gutter cover (1).

The pre-formed curved profile of the sheet (8) may also assist in guiding flexing of the sheet (8) during use. The pre-formed curved profile combined with the flexibility of the sheet (8) may make it easier to flex the longitudinal edges (16, 24) in the inward widthwise direction (32) so as to decrease the width of the gutter cover (1).

Continuing with FIG. 1, the sheet (8) of the gutter cover (1) has formed therein a plurality of throughholes (48). The throughholes (48) extend from the top surface (28) of the sheet (8) to the bottom surface (30) of the sheet (8), thereby defining a plurality of channels. When installed to cover a rain gutter, the sheet (8) captures solid particles or objects that are greater in size than the size of the throughholes (48) while the throughholes (48) permit passage of fluid therethrough.

According to one example embodiment, the throughholes (48) are arranged uniformly over the width (along the widthwise axis (27)) of the sheet (8) and over the length (along the longitudinal axis (26)) of the sheet (8).

According to an alternative example embodiment, and as illustrated in FIGS. 1, 2, 4 and 5, the throughholes (48) are arranged into a plurality of subsets of contiguously positioned throughholes (48). The subsets of contiguously positioned throughholes (48) are further positioned longitudinally, wherein adjacently positioned subsets are spaced apart along the longitudinal axis (26) from one another. A through-hole free (or solid) section (88) of the sheet (8) is further positioned between each pair of adjacently positioned subsets of contiguously positioned throughholes (48). The through-hole free sections (88) of the sheet (8) are free of (i.e. do not include) any throughholes (48). The through-hole free sections of the sheet (8) contribute to providing structural rigidity and/or resiliency to the sheet (8).

In the illustrated example, the sheet (8) has a first subset (72) of contiguously positioned throughholes and a second subset (80) of contiguously positioned throughholes. The first subset (72) and second subset (80) are adjacent one another but are spaced apart along the longitudinal axis (26). A first through-hole free section (88) of the sheet (8) is located between the first subset (72) and the second subset (80).

It is appreciated that the pattern, the shape, and the density of the throughholes can differ from the embodiment shown in the accompanying figures.

The sheet (8) may optionally have formed therein at least one fold line (96) extending along its longitudinal axis (26) and, substantially parallel to the longitudinal edges (16) and (24). The at least one fold line (96) may be folded inwardly, such as in the inward widthwise direction (32). The at least one fold line (96) may be formed by forming a recess in the sheet (8). The at least one fold line (96) may be pre-formed.

According to one example embodiment, and as illustrated, the sheet (8) includes a plurality of fold lines (96) that extend substantially parallel to one another and that are spaced-apart from one another along the widthwise axis (27). One of the fold lines (96) corresponds to a central fold line (96*c*) that extends along the longitudinal center of the sheet (8).

The at least one fold line (96) acts to increase rigidity of the sheet (8) when it is flexed in its inward widthwise direction (32). The fold lines (96) may also guide flexing of the sheet (8) in the inward widthwise direction (32). The use of pre-formed fold lines (96) may reduce the memory effect of other fold lines that may be formed in the sheet (8) during use.

It is appreciated that the number, the shape, and the configuration of the fold lines can differ from the embodiment shown in the accompanying figures.

According to various example embodiments, the sheet (8) is also substantially flexible along its longitudinal axis (26). This flexibility causes the gutter cover (1) to be rollable onto itself to define a roll. Rolling the gutter cover (1) along the longitudinal axis (26) may facilitate transportation and/or storage of the gutter cover (1).

The sheet (8) may be substantially flattened when arranged into a roll such that it has a substantially linear profile along its widthwise axis (27). This flattened shape may correspond to a stressed state of the sheet (8). This flattened shape may facilitate arrangement of the sheet (8) into the roll. When the sheet (8) is unrolled, the resiliency of the sheet (8) causes the sheet (8) to return to its pre-formed curved profile.

Figure 5:
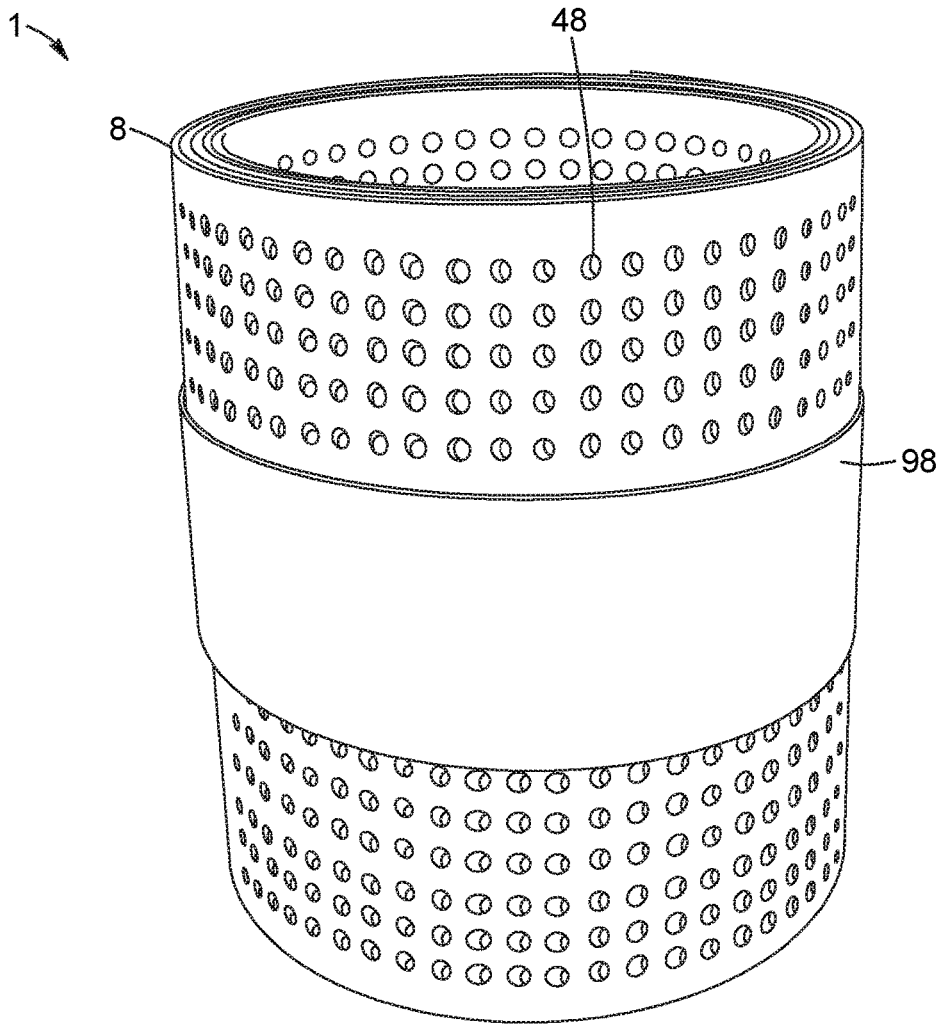
FIG. 5 illustrates a perspective view of the gutter cover in rolled configuration according to one example embodiment.

FIG. 5 illustrates a perspective view of the sheet (8) having been flattened and arranged in a roll. A retaining member (98), which may be an elastic band or a sheet of paper or plastic, is wrapped around an outer circumference of the roll so that the sheet (8) retains its rolled configuration.

As mentioned above, the sheet (8) is substantially flexible to modify its curved profile for insertion into a rain gutter channel of a rain gutter. That is, the gutter cover (1) is insertable into the rain gutter channel and is also engageable with the rain gutter to substantially close a top opening thereof.

Figure 6:
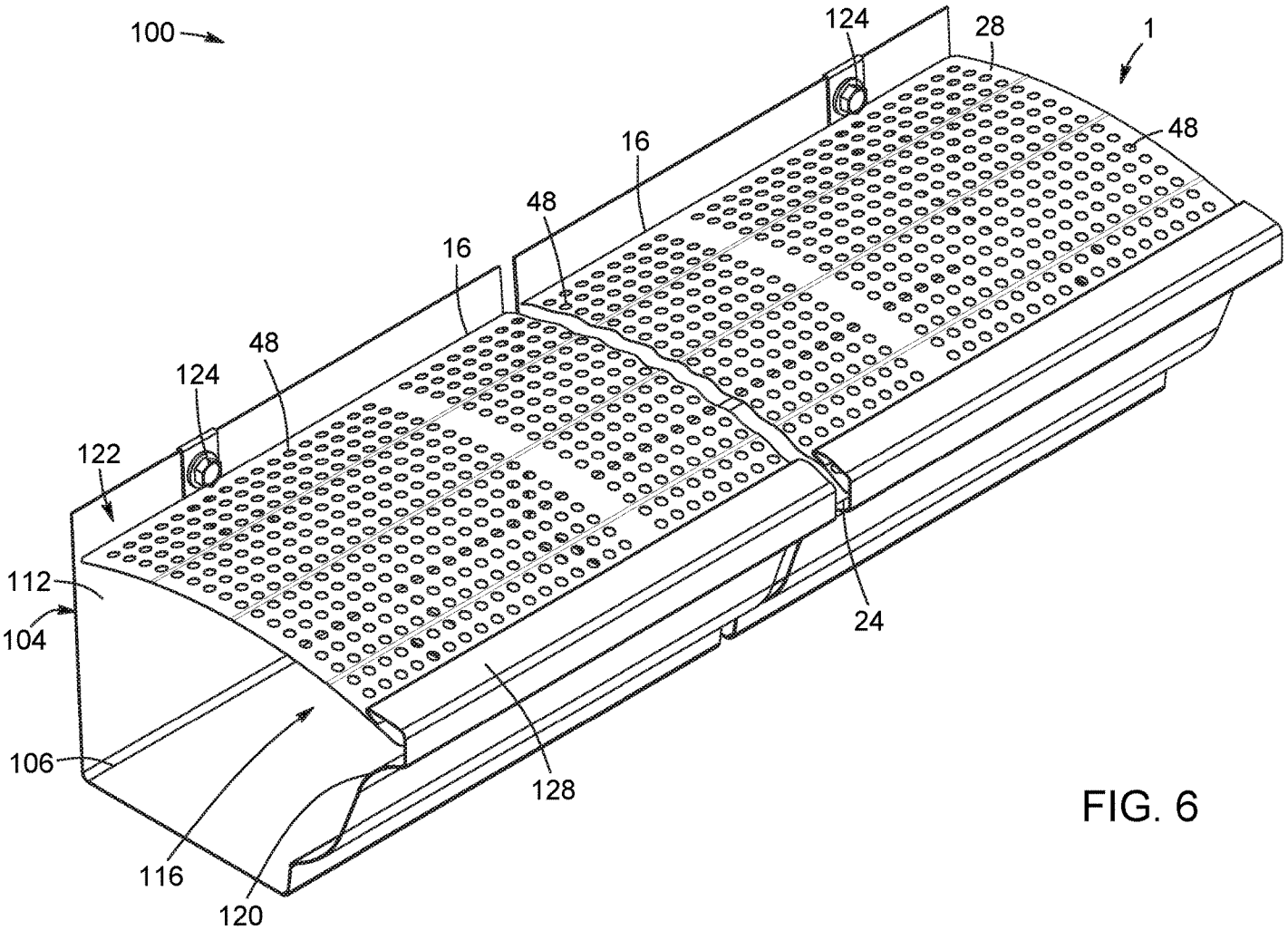
FIG. 6 illustrates a perspective view of a section of a gutter assembly in which the gutter cover of FIG. 1 is installed onto a rain gutter.

FIG. 6 illustrates a perspective view of a gutter assembly (100) according to one example embodiment in which the gutter cover (1) has been installed onto a rain gutter (104).

The rain gutter (104) includes a rain gutter body (106) having an elongated front wall (120) and an elongated rear wall (112). The elongated front wall (120) is positioned to oppose the elongated rear wall (112). The elongated front wall (120) and the elongated rear wall (112) define together a rain gutter channel (116) opened at a top opening (122).

It is appreciated that the shape and the configuration of the rain gutter can differ from the embodiment shown in FIG. 5.

The rain gutter (104) further includes inner retaining members that protrude inwardly into the rain gutter channel (116) from at least one of the elongated front wall (120) and the rear elongated wall (112).

The gutter cover (1) is insertable into the rain gutter channel (116) to substantially close the top opening (122) of the channel (116). The gutter cover (1) can be positionally maintained inside the rain gutter channel (116) by frictional engagement with the inner retaining members.

More particularly, the longitudinal edges (16, 24) are frictionally engageable with the inner retaining members under a biasing force of the sheet (8) in its outward widthwise direction (40). In an embodiment, the longitudinal edges (16, 24) are frictionally engaged with the inner retaining members by being inserted under respective ones of the inner retaining members. In an embodiment, the longitudinal edges (16, 24) of the sheet (8) are frictionally engaged with inner faces of the front and rear elongated walls (120, 112) of the rain gutter (104) under a biasing force of the sheet (8) in the outward widthwise direction (40).

When engaged in the rain gutter channel (116) of the rain gutter (104), the gutter cover (1) is flexed in the inward widthwise direction (32) and the longitudinal edges (16, 24) are biased in the outward widthwise direction (40). The sheet (8) is sufficiently resilient such that the force applied in the outward widthwise direction causes the opposing longitudinal edges (16, 24) to abut and frictionally engage inner retaining members of the rain gutter (104) when the gutter cover (1) is appropriately installed. The force on the longitudinal edges (16, 24) is sufficiently strong such that the longitudinal edges (16, 24) maintain frictional engagement when a reasonable load corresponding to flow of water and debris from the roof a building is received on the top surface (28) of the gutter cover (1).

According to one example embodiment, and as illustrated in FIG. 6, the inner retaining members include one or more gutter fasteners (124) that secure the rain gutter (104) to a support surface. The support surface may correspond to the surface of a building onto which the rain gutter (104) is mounted. Alternatively, the support surface may correspond to the surface of an intermediate member that operatively secures the rain gutter (104) to the building. When the gutter cover (1) is frictionally engaged with the rain gutter (104), a first one of the longitudinal edges (16, 24) of the sheet (8) is inserted under the one or more gutter fasteners (124). As illustrated, the respective one of the longitudinal edges (16, 24) is positioned at a height within the rain gutter channel (116) that is below the gutter fasteners (124).

As further illustrated in FIG. 6, the inner retaining members of the rain gutter (104) further include an inwardly extending upper lip (128) that extends inwardly into the rain gutter channel (116) from an upper edge of the front elongated wall (120). The sheet (8) of the gutter cover (1) is inserted under the inwardly extending upper lip (128) when frictionally engaged with the rain gutter (104). As illustrated, the respective one of the longitudinal edges (16, 24) is positioned at a height within the rain gutter channel (116) that is below the inwardly extending upper lip (128).

It is appreciated that, in an alternative embodiment (not shown), the rain gutter (104) can include an inwardly extending upper lip extending inwardly into the rain gutter channel (116) from an upper edge of the rear elongated wall (112). The inwardly extending upper lip extending inwardly from the upper edge of the rear elongated wall (112) can be used as an inner retaining member of the rain gutter (104) to frictionally engage with the sheet (8) of the gutter cover (1).

It is appreciated that the inner retaining members of the rain gutter can differ from the inwardly extending upper lip (128) and the gutter fasteners (124) shown in FIG. 6. Furthermore, it is appreciated that the shape and the configuration of the inwardly extending upper lip (128) and the gutter fasteners (124) can differ from the embodiments shown in FIG. 6.

When engaged with the rain gutter (104), the gutter cover (1) defines a concave profile, i.e. it is outwardly curved, away from the rain gutter channel (116). More particularly, a portion of the sheet (8) extending between the longitudinal edges (16, 24) is positioned in an upper portion of the rain gutter channel (116) to restrict ingress of solid particles and objects while permitting flow of fluids into the rain gutter channel (116). Due to the curved profile of the sheet (8), a middle portion of the sheet (8) corresponding to an area in proximity of the central longitudinal axis (ex: proximate the central fold line (96*c*) of the sheet (8)) is positioned at a height that is above the inner retaining members of the rain gutter (104) when the gutter cover (1) is engaged therewith.

It will be appreciated that the sheet (8) of the gutter cover (1) maintains a substantially curved profile when installed within the rain gutter (104). The sheet (8) may be slightly stressed when installed within the rain gutter (104) due to abutment and frictional engagement of the longitudinal edges (16, 24) with the rain gutter (104). The sheet (8) is biased to return to its first unstressed and pre-formed curvature.

It will be appreciated that when appropriately installed within the rain gutter (104), the gutter cover (1) is adapted to maintain its position for covering the rain gutter channel (116) while being unsecured to the rain gutter (104). Unsecured herein refers to the gutter cover (1) being engaged with the rain gutter (104) free of (i.e. without use of) any additional mechanical fasteners or adhesives for attaching/securing the gutter cover (1) to the rain gutter (104).

According to various example embodiments for installing the gutter cover (1) onto a rain gutter (104), a gutter cover (1) according to various example embodiments described herein is first provided. The gutter cover (1) may initially be provided in its rolled configuration and needs to be unrolled before installation. Furthermore, a length of the gutter cover (1) corresponding to the length of the rain gutter (104) to be covered is cut.

A force is applied to cause flexing of the sheet (8) in the inward widthwise direction, whereby a curved profile of the sheet (8) is modified.

The gutter cover (1) is inserted through the top opening (122) of the rain gutter (104) while the sheet (8) is flexed.

The gutter cover (1) is then released inside the rain gutter channel (116), whereby the longitudinal edges (16, 24) of the sheet (8) are biased in an outward widthwise direction to frictionally engage inner retaining members of the rain gutter (104). The gutter cover (1) may be appropriately positioned according to example embodiments described herein with reference to FIG. 6.

According to a method of manufacturing the gutter cover (1), a substantially flat and solid sheet (8) is initially formed. The sheet (8) may initially be in the form of a flat sheet metal, which may be aluminum. Throughholes (48) are then formed inside the sheet (8), for example, by piercing the sheet (8). The sheet (8) is further bent in along its widthwise axis (27) so as to provide its pre-formed curved profile. Optionally, folds (96), extending along the longitudinal axis (26), can be formed in the sheet (8). In some embodiments, the method of manufacturing may further include flexing the sheet (8) away from its pre-formed curved profile to become substantially flattened and rolling the sheet (8) when flattened to arrange the sheet (8) into a roll.

The gutter cover (1) described herein according to various example embodiments may be adapted to various types of rain gutters (104) to restrict ingress of solid particles into the channel of the rain gutter (104). The gutter cover (1) may be useful to cover rain gutters (104) that have already been installed onto buildings. Furthermore, the gutter cover (1) may provide ease of installation in that the gutter cover (1) engages the rain gutter (104) to maintain a proper position to cover the rain gutter channel (116) without needing to be secured to rain gutter (104) using any type of adhesive or fastener including mechanical fasteners.

Several alternative embodiments and examples have been described and illustrated herein. The embodiments described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A gutter cover engageable in a rain gutter channel to close a top opening of a rain gutter, the gutter cover comprising:

a sheet of resilient material, the sheet having a pre-formed curved profile along a widthwise axis thereof, two opposing longitudinal edges, a top surface for capturing rainwater, and a bottom surface, a plurality of throughholes formed therein, and a plurality of fold lines extending along a longitudinal axis of the gutter cover, the plurality of fold lines being located among the plurality of throughholes, the sheet being substantially flexible to modify the pre-formed curved profile for insertion into the rain gutter channel;

wherein the throughholes are arranged uniformly over the width and the length of the sheet, and extend from the top surface to the bottom surface and permit passage of the rainwater captured on the top surface of the sheet to the bottom surface;

wherein the plurality of fold lines are spaced apart from the two opposing longitudinal edges of the sheet, at least one fold line having throughholes located on both sides of the at least one fold line;

wherein the sheet is flexible along a longitudinal axis thereof, whereby the sheet is rollable into a roll; and wherein the top surface of the sheet defines a first substantially smooth curve extending over an entire width of the sheet.

2. The gutter cover of claim 1, wherein the pre-formed curved profile is arch-shaped.

3. The gutter cover of claim 1, wherein the two opposing longitudinal edges of the sheet are biased in an outward widthwise direction when the sheet is flexed in an inward widthwise direction.

4. The gutter cover of claim 3, wherein the two opposing longitudinal edges are biased in an inward widthwise direction when the sheet is flexed in an outward widthwise direction.

5. The gutter cover of claim 1, wherein the at least one fold line is folded inwardly.

6. The gutter cover of claim 1, wherein the plurality of fold lines extend substantially parallel to one another and are spaced-apart from one another along the widthwise axis with a central fold line extending substantially along a longitudinal center of the sheet.

7. The gutter cover of claim 1, wherein the plurality of fold lines increase rigidity of the sheet when the sheet is flexed in an inward widthwise direction.

8. The gutter cover of claim 1, wherein the plurality of fold lines guide flexing of the sheet when the sheet is flexed in an inward widthwise direction.

9. The gutter cover of claim 1, wherein the bottom surface of the sheet defines a second substantially smooth curve extending over the entire width of the sheet.

10. The gutter cover of claim 1, wherein the sheet is substantially flattened when the sheet is rolled and wherein the sheet substantially returns to the pre-formed curved profile when unrolled.

11. A gutter assembly comprising the gutter cover according to claim 1;

the rain gutter having a rain gutter body with an elongated front wall and an elongated rear wall defining the rain gutter channel with the top opening, the rain gutter including inner retaining members protruding inwardly inside the rain gutter channel from the elongated front and rear walls; and wherein the gutter cover is insertable in the rain gutter channel to substantially close the top opening thereof and the sheet being maintained inside the rain gutter channel by frictionally engaging the inner retaining members of the rain gutter.

12. The gutter assembly of claim 11, wherein the two opposing longitudinal edges of the sheet are frictionally engageable with inner faces of the front and rear elongated walls of the rain gutter under a biasing force of the sheet in an outward widthwise direction.

13. The gutter assembly of claim 11, wherein, when engaged in the rain gutter channel of the rain gutter, the gutter cover is flexed in an inward widthwise direction and the two opposing longitudinal edges are biased in an outward widthwise direction.

14. The gutter assembly of claim 11, wherein the inner retaining members comprise one or more gutter fasteners for securing the rain gutter to a support surface, the sheet being inserted under the one or more gutter fasteners when engaged with the rain gutter.

15. The gutter assembly of claim 11, wherein the inner retaining members comprise an inwardly extending upper lip of the rain gutter extending inwardly into the rain gutter channel from an upper edge of a respective one of the front and the rear elongated walls, the sheet being inserted under the inwardly extending upper lip of the rain gutter when engaged therewith.

16. The gutter assembly of claim 11, wherein a middle portion of the sheet extends above the inner retaining members when engaged therewith.

17. The gutter assembly of claim 11, wherein the gutter cover is frictionally engaged with the rain gutter without use of mechanical fasteners or adhesives.

18. A method of installing a gutter cover to cover a top opening of a rain gutter, the method comprising:

providing the gutter cover according to claim 1;

applying a force to cause flexing of the sheet of the gutter cover in an inward widthwise direction of the gutter cover;

inserting the gutter cover while the sheet is flexed through the top opening of the rain gutter; and releasing the gutter cover inside the rain gutter channel, whereby the two opposing longitudinal edges of the sheet of the gutter cover are biased in an outward widthwise direction to frictionally engage inner retaining members of the rain gutter.

19. The gutter cover of claim 1, wherein the sheet of resilient material consists of a single layer of sheet material.

20. The gutter cover of claim 1, further comprising a retaining member wrapped around an outer circumference of the sheet when rolled into the roll, wherein the sheet is retained in a rolled configuration.

21. The gutter cover of claim 1, wherein the plurality of fold lines are dispersed along the width of the sheet.

22. A gutter cover engageable in a rain gutter channel to close a top opening of a rain gutter, the gutter cover comprising:

a sheet of resilient material, the sheet having a pre-formed curved profile along a widthwise axis thereof, two opposing longitudinal edges, a top surface for capturing rainwater and a bottom surface, a plurality of through-holes formed therein, and a plurality of fold lines extending along a longitudinal axis of the gutter cover and being located amongst the plurality of through-holes, the sheet being substantially flexible to modify the pre-formed curved profile for insertion into the rain gutter channel; and wherein the throughholes are arranged uniformly over the width and the length of the sheet, extend from the top surface to the bottom surface and permit passage of the rainwater captured on the top surface of the sheet to the bottom surface;

wherein the plurality of fold lines are spaced apart from the two opposing longitudinal edges of the sheet, at least one fold line having throughholes located on either side of the fold line;

wherein the sheet is flexible along a longitudinal axis thereof, whereby the sheet is rollable into a roll; and wherein the bottom surface of the sheet defines a substantially smooth curve extending over an entire width of the sheet.

23. The gutter cover of claim 22, wherein the pre-formed curved profile is arch-shaped.

24. The gutter cover of claim 22, wherein the two opposing longitudinal edges of the sheet are biased in an outward widthwise direction when the sheet is flexed in an inward widthwise direction.

25. The gutter cover of claim 22, wherein the plurality of fold lines is folded inwardly.

26. The gutter cover of claim 22, wherein the plurality of fold lines extend substantially parallel to one another and are spaced-apart from one another along the widthwise axis with a central fold line extending substantially along a longitudinal center of the sheet.

27. The gutter cover of claim 22, wherein the plurality of fold lines increases rigidity of the sheet when the sheet is flexed in an inward widthwise direction.

28. The gutter cover of claim 22, wherein the plurality of fold lines guides flexing of the sheet when the sheet is flexed in an inward widthwise direction.

29. The gutter cover of claim 22, wherein the sheet is substantially flattened when the sheet is rolled and wherein the sheet substantially returns to the pre-formed curved profile when unrolled.

30. The gutter cover of claim 22, wherein the sheet of resilient material consists of a single layer of sheet metal.

31. The gutter cover of claim 22, further comprising a retaining member wrapped around an outer circumference of the sheet when rolled into the roll, whereby the sheet is retained in its rolled configuration.

32. The gutter cover of claim 22, wherein the plurality of fold lines are dispersed along the width of the sheet.

33. A gutter assembly comprising:

a gutter cover according to claim 22; and the rain gutter, having a rain gutter body with an elongated front wall and an elongated rear wall defining the rain gutter channel with the top opening, the rain gutter including inner retaining members protruding inwardly inside the rain gutter channel from the elongated front and rear walls; and wherein the gutter cover is insertable in the rain gutter channel to substantially close the top opening thereof and the sheet being maintained inside the rain gutter channel by frictionally engaging the inner retaining members of the rain gutter.

34. The gutter assembly of claim 30, wherein the two opposing longitudinal edges of the sheet are frictionally engageable with inner faces of the front and rear elongated walls of the rain gutter under a biasing force of the sheet in an outward widthwise direction.

35. The gutter assembly of claim 30, wherein, when engaged in the rain gutter channel of the rain gutter, the gutter cover is flexed in an inward widthwise direction and the two opposing longitudinal edges are biased in an outward widthwise direction.

36. The gutter assembly of claim 30, wherein the inner retaining members comprise one or more gutter fasteners for securing the rain gutter to a support surface, the sheet being inserted under the one or more gutter fasteners when engaged with the rain gutter.

37. The gutter assembly of claim 30, wherein the inner retaining members comprise an inwardly extending upper lip of the rain gutter extending inwardly into the rain gutter channel from an upper edge of a respective one of the front and the rear elongated walls, the sheet being inserted under the inwardly extending upper lip of the rain gutter when engaged therewith.

38. The gutter assembly of claim 30, wherein a middle portion of the sheet extends above the inner retaining members when engaged therewith.

39. The gutter assembly of claim 30, wherein the gutter cover is frictionally engaged with the rain gutter without use of mechanical fasteners or adhesives.

40. A method of installing a gutter cover to cover a top opening of a rain gutter, the method comprising:

providing the gutter cover according to claim 22;

applying a force to cause flexing of the sheet of the gutter cover in an inward widthwise direction of the gutter cover;

inserting the gutter cover while the sheet is flexed through the top opening of the rain gutter; and releasing the gutter cover inside the rain gutter channel, whereby the two opposing longitudinal edges of the sheet of the gutter cover are biased in an outward widthwise direction to frictionally engage inner retaining members of the rain gutter.

* * * * *